US005097544A

United States Patent [19]

Barabas

[11] Patent Number: 5,097,544

[45] Date of Patent: Mar. 24, 1992

[54] CONVERTIBLE SOFA BED

[75] Inventor: John Barabas, Carle Place, N.Y.

[73] Assignee: Castro Convertible Corporation, New Hyde Park, N.Y.

[21] Appl. No.: 724,921

[22] Filed: Jul. 2, 1991

[51] Int. Cl.[5] ..... A47C 17/13; A47C 17/22

[52] U.S. Cl. ..... 5/13; 5/29

[58] Field of Search ..... 5/13, 14, 28, 29-36, 5/51.1

[56] References Cited

U.S. PATENT DOCUMENTS 3,284,812 11/1966 Koch ..... 5/13

3,654,642 4/1972 Barabas ..... 5/13

*Primary Examiner*—Alexander Grosz

*Attorney, Agent, or Firm*—Fitzpatrick, Cella, Harper & Scinto

[57] ABSTRACT

A convertible sofa bed is disclosed which includes an improved folding bed mechanism which consists of a support section, intermediate section, a center section and a foot section all pivotally connected together by a linkage which permits the sections to be pivoted between an extended position wherein they are linearly aligned and a folded position wherein the foot section extends in a substantially horizontal plane parallel to the intermediate and support sections and the center section extends substantially vertically between the intermediate and foot sections. The linkage allows the folded center and intermediate sections to move into and downwardly in the frame adjacent the support section and includes a push linkage assembly which operates to permit the folded over sections to move into the frame. The push linkage assembly consists of a plurality of links interconnected to each other and to the intermediate frame to remain adjacent the intermediate frame during the folding operation and avoid interference with folding of the mattress contained on the frame.

4 Claims, 3 Drawing Sheets

CONVERTIBLE SOFA BED

The present invention relates to convertible sofa beds, and more particularly to an improved linkage for a sofa bed mechanism which reduces interference between the mechanism and the mattress.

BACKGROUND OF THE INVENTION

Convertible sofa bed mechanisms are in common use today particularly in boats, hotels, and homes where floor space is at a premium. Such products permit a single piece of furniture to serve different purposes during different periods of the day. A particularly successful convertible sofa bed mechanism has been sold for many years by the assignee of this application, Castro Convertible Corporation. The basic structure and operation of that mechanism is described and disclosed in U.S. Pat. No. 3,284,812. A slightly modified and updated version of the mechanism is also disclosed in U.S. Pat. No. 3,654,642.

The mechanism of the two above-described patents, as manufactured and sold by Castro Convertible Corporation, has been found to be very successful in use and operation. The mechanism is extremely durable and economical to manufacture.

Despite the success of such mechanisms, it has been found that the edge of the mattress or loose bedclothing on the mattress supported in the mechanism can sometimes become caught or pinched in the mechanism as it is folded. This could interfere with the folding operation of the mechanism or damage the mattress or bedclothing.

It is an object of the present invention to provide an improved folding bed mechanism which reduces the possibility of interference between the mechanism and the mattress or bedclothing thereon.

Another object of the present invention is to provide a compact folding bed mechanism of relatively high strength and automatic operation.

Yet another object of the present invention is to provide a folding bed mechanism which is relatively simple to operate and to manufacture.

In accordance with an aspect of the present invention a convertible sofa is provided which includes a frame and a folding bed mechanism mounted on the frame to swing into and out of the frame between folded and extended position. The mechanism includes a plurality of bed sections which are pivotally connected in series and consists of a support or head section located generally within the frame, an intermediate section pivotally connected to the support section, a center section pivotally connected to the intermediate section, and a foot section pivotally connected to the center section. A linkage arrangement is operatively connected between these sections to permit the sections to be pivoted relative to each other between the extended position wherein the sections are linearly aligned and a folded position wherein the foot section extends in a substantially horizontal plane parallel to and above the intermediate sections with the center section extending substantially vertically between the intermediate and foot sections. The linkage mechanism includes means which allows the folded foot, center and intermediate sections to move into and downwardly in the frame adjacent the support section to define the closed position of the convertible sofa.

The mechanism also includes a spring biased support bar pivotally connected to the frame and locking means pivotally connected to the intermediate section for locking the intermediate, center and foot sections in the extended position. A push linkage assembly is connected between the locking means and the spring biased support bar to apply a force to the bar against the bias of the spring to release the mechanism and allow it to be folded into the sofa frame. The push linkage assembly includes a first link pivotally connected at one end to the locking means and pivotally connected at its other end to a connector link which is in turn pivotally connected to the intermediate section of the folding bed mechanism. The connector link is also pivotally connected to a third link which is in turn pivotally connected to the intermediate section and to the support bar. As a result of this arrangement, movement of the locking mechanism during movement of the foot and center sections to the folded position pivots the connector link and third link against the bias of the support arm to allow the folded over foot, center and intermediate sections to move into and downwardly in the frame. In addition, the multilink push assembly allows the links to remain close to the intermediate section during folding of the bed, out of the way of the mattress and any bedclothing thereon.

The above, and other objects, features and advantages of the present invention will be apparent to those skilled in the art from the following detailed description of an illustrated embodiment of the invention where illustrated in the accompanying drawings wherein.

Figure 1:
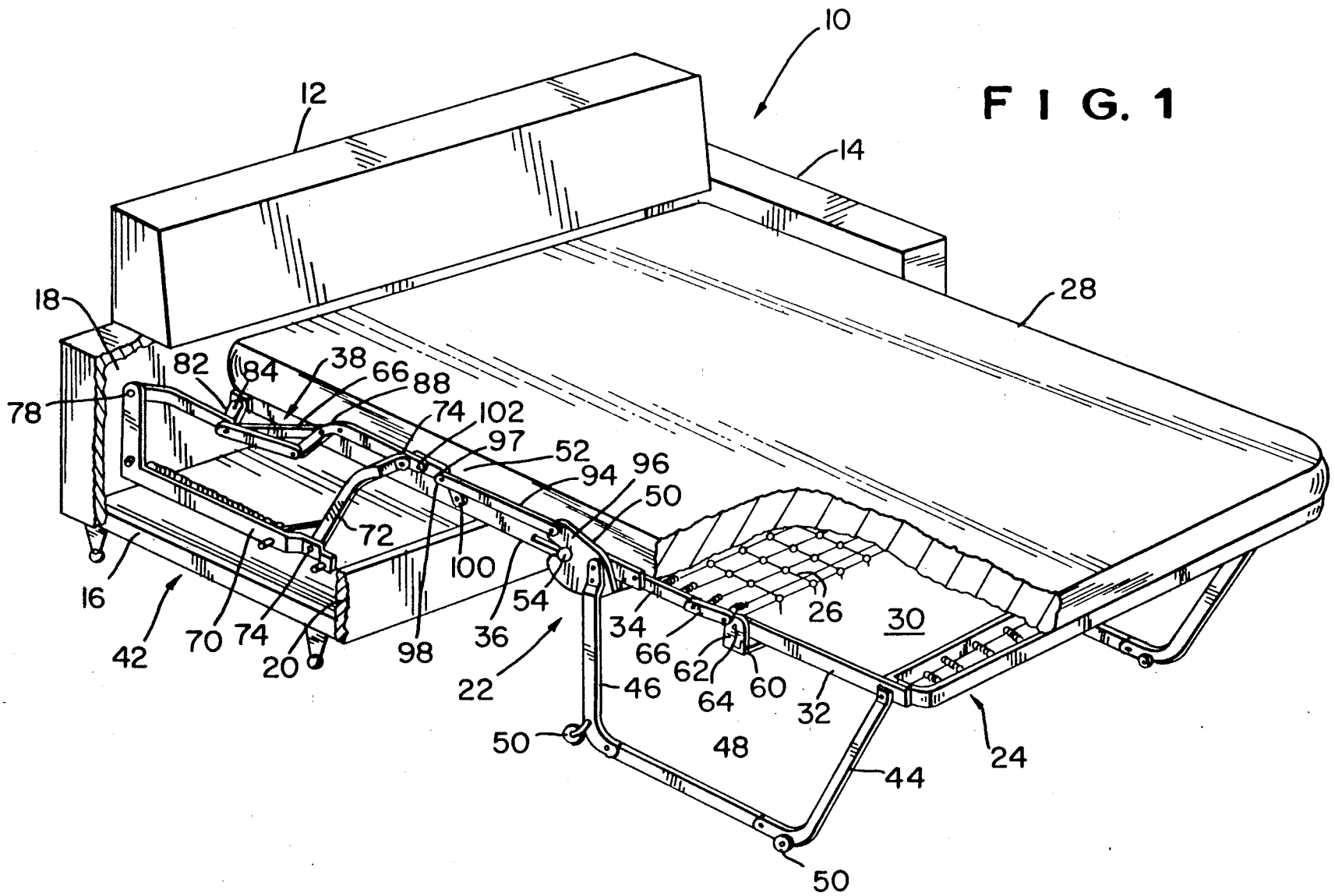
FIG. 1 is a partially broken away view of the sofa bed of the present invention, with the bed unfolded in its extended position.

Referring now to the drawing in detail, and initially to FIG. 1 thereof, the sofa bed 10 of the present invention includes an upholstered frame having a back 12 and arms 14 with removable seat cushions (not shown).

As noted above, the mechanism of the present invention is an improvement over the standard mechanism described in the above two identified patents and sold by Castro Convertible Corporation. The sofa frame is of conventional construction and is generally rectangular in plan and hollow. It includes side frame members 16, rear frame member 18 and a relatively low front wall frame member 20. The side walls and frame elements provide a well beneath the lower edge of the back cushions into which a plurality of hingedly interconnected bed sections fit when in a folded condition.

As seen in FIG. 1, the mechanism 22 of the present invention includes a metal frame 24 which supports a spring mounted wire mesh 26 or the like which in turn supports a foldable mattress 28. In some embodiments a canvas material 30 can form a portion of the mattress support at the outermost end or foot of the bed.

The frame 22 is longitudinally divided into four sections, an outermost or foot section 32, a center section 34, an intermediate section 36, and a head or support section 38. These sections are pivotally interconnected to each other and to a folding bed mechanism or linkage system which performs the function of supporting the bed in its extended sleeping position and guiding it into a folded position for storage in the sofa bed frame. The mechanism on each side of the sofa is the mirror image of the other, so that only one such mechanism is described and illustrated in the drawings.

The folding bed mechanism on each side of the frame 24 includes a forward linkage portion indicated generally at 40 and a rear linkage portion indicated generally at 42. The forward linkage portion includes a front leg 44 and an intermediate leg 46 pivotally connected by a connecting leg or bar 48. Rollers 50 may be connected to the ends of the legs in order to prevent scuffing of the floor or carpet on which the sofa bed sits as the mechanism is being folded and unfolded. The leg 44 is pivotally connected to the forward portion of the foot section 32. The upper end of leg 46 is pivotally connected to the forward portion of intermediate section 36 of frame 22. The upper end of leg 46 is also secured to a cam plate or locking means 50 which is connected to the pusher linkage assembly 52 which constitutes the improvement of the present invention. That linkage connects with the rear linkage 42 as described hereinafter.

A locking projection or lug 54 fits into a slot 56 formed in the cam plate 50 to lock the bed in its open position.

The forward linkage just described operates to aid in folding and supporting the bed substantially in the manner described in U.S. Pat. No. 3,284,812 mentioned above and need not be further described herein.

An elongated bar plate 60 extends between two brackets 62 on opposite sides of the bed. The brackets 62 are pivoted to the foot section 32 at pivot point 64. A link 66 is pivotally connected between the upper end of bracket 62 and the center section 34 of the sofa bed. When the sofa bed is completely folded the plate 60 swings into a position on the top of the front edge of the folded bed and prevents the seat cushions from being pressed downwardly between the footboard 20 of the sofa frame and the folded mechanism. This feature is optional and need not be used unless desired. In any event, the link 66 causes the plate 60 to swing downwardly and away from the mattress support 26 so that the person sleeping on the bed will not feel the sharp edges of the plate.

The rear linkage 42 includes a mounting bracket 70 which is secured to the side of the sofa frame by means of screws or bolts. The intermediate section 36 of the sofa bed mechanism is supported in the open position of the sofa by means of a front support member 72 in linkage 42. Support member 72 is pivotally connected to the bracket 70 at pivot point 74 and a conventional tension spring 76 is attached to an extension or arm 75 on support member 72 to provide a spring force which aids in opening and closing the sofa bed, as is known in the prior art.

Intermediate section 36 is also supported by a rear link 77 which is pivotally connected at 78 to mounting bracket 70. Link 77 is also pivotally connected at 80 to a swing link 82 pivotally connected at 84 to the support section 38. In addition, a further link 86 is pivotally connected at its ends between the pivot point 80 and another pivot point 88 on one of the links 104 of push assembly 52. Finally, a further link 90 is pivotally connected at its ends between the pivot point 80 and the pivot point 92 at the end of the push link assembly.

The push linkage assembly 52 includes a first link 94 pivotally connected at one end to the elongated tongue 96 defined by the periphery of cam plate 50 and slot 56 therein. The opposite end of link 94 is pivotally connected at 97 to intermediate link 98. The latter is pivotally connected at 100 to the intermediate frame 36 and at its opposite end 102 to link 104. That link is pivotally connected, as described above, at 74 to the support bar 72 and at points 88 and 92 to the links 86 and 90, respectively.

Figure 2:
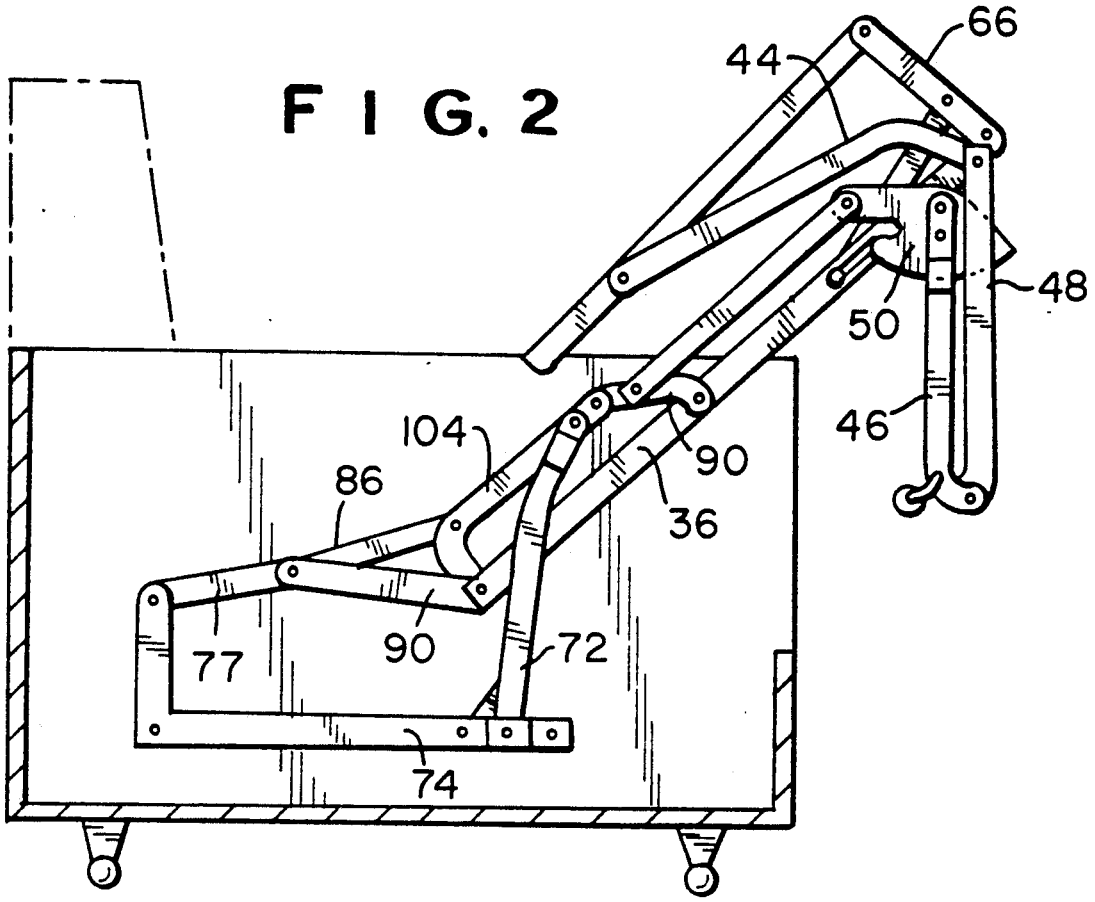
FIG. 2 is a side view of the sofa frame and mechanism during an intermediate stage of the folding or unfolding operation.
Figure 3:
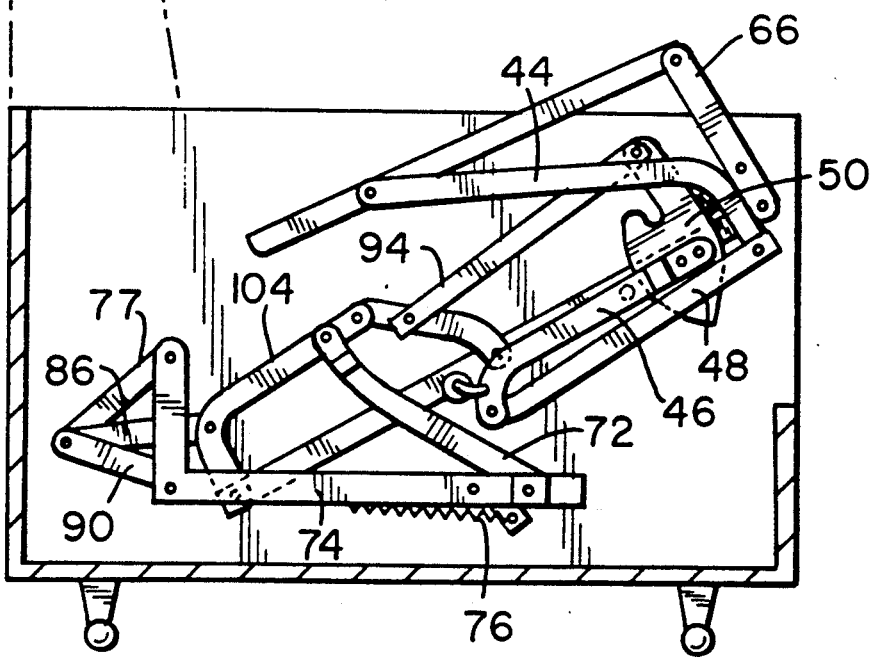
FIG. 3 is a side view similar to FIG. 2 showing the mechanism as it is moving into or out of the sofa frame.
Figure 4:
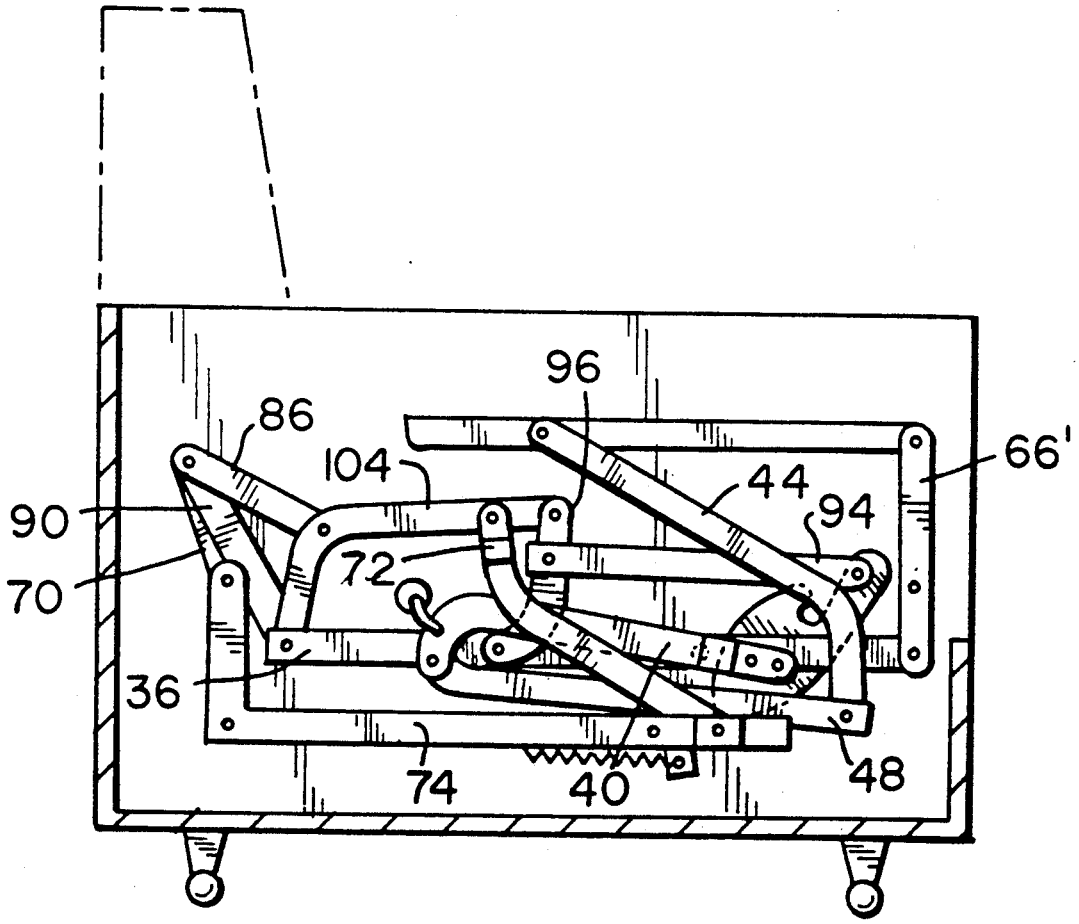
FIG. 4 is a side view similar to FIGS. 2 and 3 showing the mechanism entirely in the folded position within the sofa frame.

As seen in FIGS. 2–4, the linkage mechanism thus described operates to guide the sofabed mechanism in a relatively low trajectory so that it easily passes over the front frame 20, and into the well defined by the frame.

Upon movement of the foot section 32 relative to the center section 34 of the frame, the connecting link 48 moves upwardly adjacent to leg 46 and continued movement causes the lug 54 to move out of the slot 56, as described in U.S. Pat. No. 3,284,812. Continued lifting of the foot section causes pivoting of the center section 34 and the entire mechanism to move to the position shown in FIG. 2. This action causes the tongue 96 of the locking plate 50 to apply a force to the push linkage mechanism 52, towards the left in the drawing. This results in a force being applied to the upper end of the support link 72 against the bias of the spring 76 and permits the intermediate section 36 to move about its pivotal connection with the head section 38. At the same time, plate 50 rotates bringing its peripheral edge into engagement with lug 54 to lock the bed in its folded position. The bed sections are then moved laterally towards the well of the sofa as shown in FIGS. 3 and 4. This results in lateral movement inwardly of both the push linkage 52 and the intermediate section 36 causing the link 76 to rotate. Ultimately, link 98 reaches an over the center position and the spring 76 is then effective to hold the folding mechanism down in its folded position.

By the construction of this invention, particularly by the use of the push linkage assembly 52, links 94 and 104 provide a more compact arrangement then the single link used in the prior art mechanism (i.e. link 83 in U.S. Pat. No. 3,284,812). Thus, as the mechanism is closed, these links remain closer to the frame of the intermediate section 36 than occurred in the prior art. In addition, the arrangement permits tongue 96 of cam plate 50 to be made shorter than was possible with the prior art devices. By making this tongue shorter (i.e., one inch or more) and by keeping the linkage closer to the sides of the intermediate frame 36, there is reduced possibility of the mattress or its bedding covering becoming pinched in the mechanism and interfering with operation thereof. As a result, a smoother operating mechanism is provided.

Although the invention has been described in connection with an illustrative embodiment thereof, it is to be understood that various changes and modifications may be effected therein by those skilled in the art within departing from the scope or spirit of this invention.

What is claimed is:

1. A convertible sofa comprising a frame and a folding bed mechanism mounted on the frame to swing into and out of the frame between folded and extended positions, said mechanism including a plurality of bed sections pivotally connected in series and constituting a support section located generally within said frame, an intermediate section pivotally connected to the support section, a center section pivotally connected to the intermediate section and a foot section pivotally connected to the center section; and linkage means operatively interconnecting said sections for permitting the sections to be pivoted relative to each other between said extended position wherein the sections are linearly aligned and said folded position wherein the foot section extends in a substantially horizontal plane parallel to and above said intermediate and support sections and the center section extends substantially vertically between the intermediate and foot sections; said linkage means including means for allowing the folded over foot, center and intermediate sections to move into and downwardly in the frame adjacent said support section; said moving means including a spring biased support bar pivotally connected to said frame, locking means pivotally connected to said intermediate section for locking said intermediate, center and foot sections in said extended position and for unlocking said sections when the foot section is manually pivoted upwardly about said center section towards the folded position, and a push linkage assembly connected between said locking means and said support bar, said push linkage assembly including a first link pivotally connected at its first end to said locking means; a connector link pivotally connected at one end to said intermediate section and pivotally connected to the second end of said first link; and a third link pivotally connected at one end to said connector link above the latter's connection to the intermediate section and pivotally connected at its opposite end to said frame, said support bar being pivotally connected to said third link, whereby movement of the locking means during movement of said foot and center sections to the folded positions pivots said connector link and third link against the bias of said support arm to allow the folded over foot, center and intermediate sections to move into and downwardly in the frame.

2. A convertible sofa bed as defined in claim 1 wherein said locking means has an elogated slot formed therein extending generally horizontally when the folding bed mechanism is in its extended position, said slot defining a finger with the periphery of the locking means which is generally aligned with said first link in the extended position of the folding mechanism.

3. A convertible sofa comprising a frame and a folding bed mechanism mounted on the frame to swing into and out of the frame between folded and extended positions, said mechanism including a support section located generally within said frame, an intermediate section pivotally connected to the support section, a center section pivotally connected to the intermediate section and a foot section pivotally connected to the center section; and linkage means operatively interconnecting said sections for permitting the sections to be pivoted relative to each other between said extended position wherein the sections are linearly aligned and said folded position wherein the foot section extends in a substantially horizontal plane parallel to said intermediate and support sections and the center section extends substantially vertically between the intermediate and foot sections; said linkage means including means for allowing the folded over foot, center and intermediate sections to move into and downwardly in the frame adjacent said support section; said moving means including a spring biased support bar pivotally connected to said frame, locking means for locking said intermediate, center and foot sections in said extended position, and a push linkage assembly connected between said locking means and said support bar, said push linkage assembly including a plurality of links pivotally connected between said locking means and said support bar for applying a force from said locking means to said support bar and against the bias of said support bar, whereby movement of the locking means during movement of said foot, center and intermediate sections to the folded position pivots said push linkage assembly and said support arm to allow the folded over foot, center and intermediate sections to move into and downwardly in the frame.

4. A convertible sofa as defined in claim 3 wherein said push linkage assembly includes first, second and third links, said first link being pivotally connected at one end to the locking means and at its other end to said second link; said second link being pivotally connected at one end to said intermediate section and at its other end to said third link; and said third link being pivotally connected to said frame and to said support arm.

* * * * *